US005666748A

United States Patent [19]

Emrich et al.

[11] Patent Number: 5,666,748

[45] Date of Patent: Sep. 16, 1997

[54] WEAR CAP AND COMPONENTS USEABLE THEREWITH

[75] Inventors: Robert K. Emrich, Tigard, Oreg.; Eric D. Anderson, Woodland, Wash.

[73] Assignee: ESCO Corporation, Portland, Oreg.

[21] Appl. No.: 570,437

[22] Filed: Dec. 11, 1995

[51] Int. Cl.[6] ..... E02F 9/28

[52] U.S. Cl. ..... 37/453; 37/455; 37/457; 403/374

[58] Field of Search ..... 37/453, 454, 455, 37/456, 457; 172/713, 772, 772.5; 403/379, 374, 373

[56] References Cited

U.S. PATENT DOCUMENTS

| | | | |
|---|---|---|---|
| Re. 33,454 | 11/1990 | Potter . | |
| 2,032,875 | 3/1936 | Graham | 37/453 |
| 2,204,718 | 6/1940 | Younie | 37/456 |
| 2,762,139 | 9/1956 | Launder | 37/453 |
| 2,896,345 | 7/1959 | Peklay | 37/453 |
| 2,934,842 | 5/1960 | Van Buskirk | 37/456 |
| 3,462,861 | 8/1969 | Kampert | 37/453 |
| 3,845,578 | 11/1974 | Holmstrom | 37/453 X |
| 4,326,348 | 4/1982 | Emrich . | |
| 4,335,532 | 6/1982 | Hahn et al. . | |
| 4,428,131 | 1/1984 | Hahn . | |
| 4,587,751 | 5/1986 | Sjogren et al. | 37/453 |
| 4,716,667 | 1/1988 | Martin . | |
| 4,762,372 | 8/1988 | Rassmann et al. | 37/457 X |
| 5,056,243 | 10/1991 | Sprunger et al. | 37/453 |
| 5,075,986 | 12/1991 | Smith et al. | 37/457 |
| 5,088,214 | 2/1992 | Jones . | |
| 5,224,282 | 7/1993 | Swick | 37/453 |
| 5,241,765 | 9/1993 | Jones et al. . | |
| 5,337,495 | 8/1994 | Pippens | 37/453 |
| 5,526,592 | 6/1996 | Bierwith . | |

FOREIGN PATENT DOCUMENTS

| | | | |
|---|---|---|---|
| 605675 | 9/1960 | Canada | 37/453 |
| 812138 | 5/1969 | Canada | 37/453 |

*Primary Examiner*—Terry Lee Melius
*Assistant Examiner*—Victor Batson
*Attorney, Agent, or Firm*—Banner & Witcoff, Ltd.

[57] ABSTRACT

A wear cap for protecting the wearable surface of a structural member includes an outer wear surface and an inner mounting surface. The inner mounting surface is provided with a plurality of tabs and a lock which cooperate to securely attach the wear cap to the wearable surface. The tabs are inclined in a uniform direction at an acute angle to the mounting surface to minimize the amount of travel needed to install and remove the wear cap. The lock has a rigid hub and a shaft. The hub includes a pair of bearing faces which interact with the wear cap and the wearable surface to effectively prevent loss of the wear cap during use.

47 Claims, 14 Drawing Sheets

WEAR CAP AND COMPONENTS USEABLE THEREWITH

FIELD OF THE INVENTION

The present invention pertains to wear members, and in particular, to the use of wear caps to protect surfaces subjected to wear.

BACKGROUND OF THE INVENTION

Excavating equipment in normal use is subjected to conditions which cause significant wearing of the components. To lengthen the usable life of the equipment, wear caps have been secured over the surfaces experiencing the greatest amount of wear. For instance, wear caps have been provided along the walls of a dragline bucket as set forth in U.S. Pat. No. Re. 33,454 to Potter and U.S. Pat. No. 5,241,765 to Jones et al. Wear caps have also been used to cover exposed portions of an adapter such as disclosed in U.S. Pat. No. 4,326,348 to Emrich, U.S. Pat. No. 4,335,532 to Hahn et al., U.S. Pat. No. 4,428,131 to Emrich, and U.S. Pat. No. 4,716,667 to Martin.

Wear caps are frequently provided with a slot which is received over a tongue fixed to a wearable surface of the part to be protected. The slot is generally formed with a T-shaped configuration (e.g., U.S. Pat. No. 4,335,532) or a dovetail configuration (e.g., U.S. Pat. No. Re. 33,454) to prevent the wear cap from being pulled away from the wearable surface. While a slot and tongue connection is sufficient to hold the wear cap to the wearable surface, it at times places undesirable constraints on the design of the wearable part. Specifically, the use of a slot and tongue connection to secure the wear cap requires the wearable surface to have a relatively flat or linear shape. Accordingly, as seen for example in U.S. Pat. No. 4,335,532, the wearable surface of the adapter is built up to form a linear T-shaped tongue. This tongue construction requires the use of more material than would otherwise be required to provide the adapter with a sufficient level of strength.

Further, a tongue and slot connection generally requires the wear cap to be axially moved a considerable distance (up to 100% of its length) for installation and removal. Removal of a wear cap via a long sliding motion has proven to be very difficult when tightly compacted with soil fines. Further, such axial movement of the wear cap frequently requires the removal of other parts (e.g., points) in order to provide sufficient clearance.

Wear caps typically rely upon the attachment of another wear member to hold it in place. For example, the wear caps disclosed in U.S. Pat. Nos. 4,335,532 and U.S. Pat. No. 4,716,667 are each held to its respective wearable surface by the attachment of a point to the adapter. As a result, the point must always be removed to replace a worn wear cap, even if the point itself does not need to be replaced. Further, this dependent mounting of the wear cap may cause both the wear cap and the point to be lost if the point should break during use. Also, the requirement to interconnect the two wear members results in a more difficult assembly process.

SUMMARY OF THE INVENTION

The present invention pertains to the use of a wear cap to protect the wearable surface of a structural member subjected to wearing by the relative sliding movement of another material, such as experienced in excavating equipment. The wear cap of the present invention is secured to the wearable surface through the combined use of tabs and a lock. The wear caps are well suited for attachment to either planar or non-planar surfaces. As a result, the need to compromise the design of a surface for attachment of a wear cap is avoided.

The tabs and lock cooperate to provide a high level of strength in the wear cap connection which can independently secure the wear cap to the wearable surface. In this way, the wear cap remains attached to the wearable surface even if the point or other wear member should break. Independent mounting also in certain environments enables the wear cap to be removed without removing other parts.

The projecting tabs are inclined in a uniform direction at an acute angle to the mounting surface of the wear cap to minimize the amount of travel needed to install and remove the wear cap. This construction also minimizes the clearance required to permit removal or installation of the wear cap without removing other parts. The inclined tabs further ease removal of the wear cap in environments wherein soil fines compact tightly about the parts.

The lock has a rigid hub and a shaft. The hub includes a pair of bearing faces which interact with the wear cap and the wearable surface to effectively prevent loss of the wear cap during use. The lock is mounted for rotation of the hub between a release position and a locked position. The use of a simple rotation of the hub enables the lock to be easily released despite the heavy compaction of soil fines.

DETAILED DESCRIPTION OF THE PREFERRED EMBODIMENTS

Figure 1:
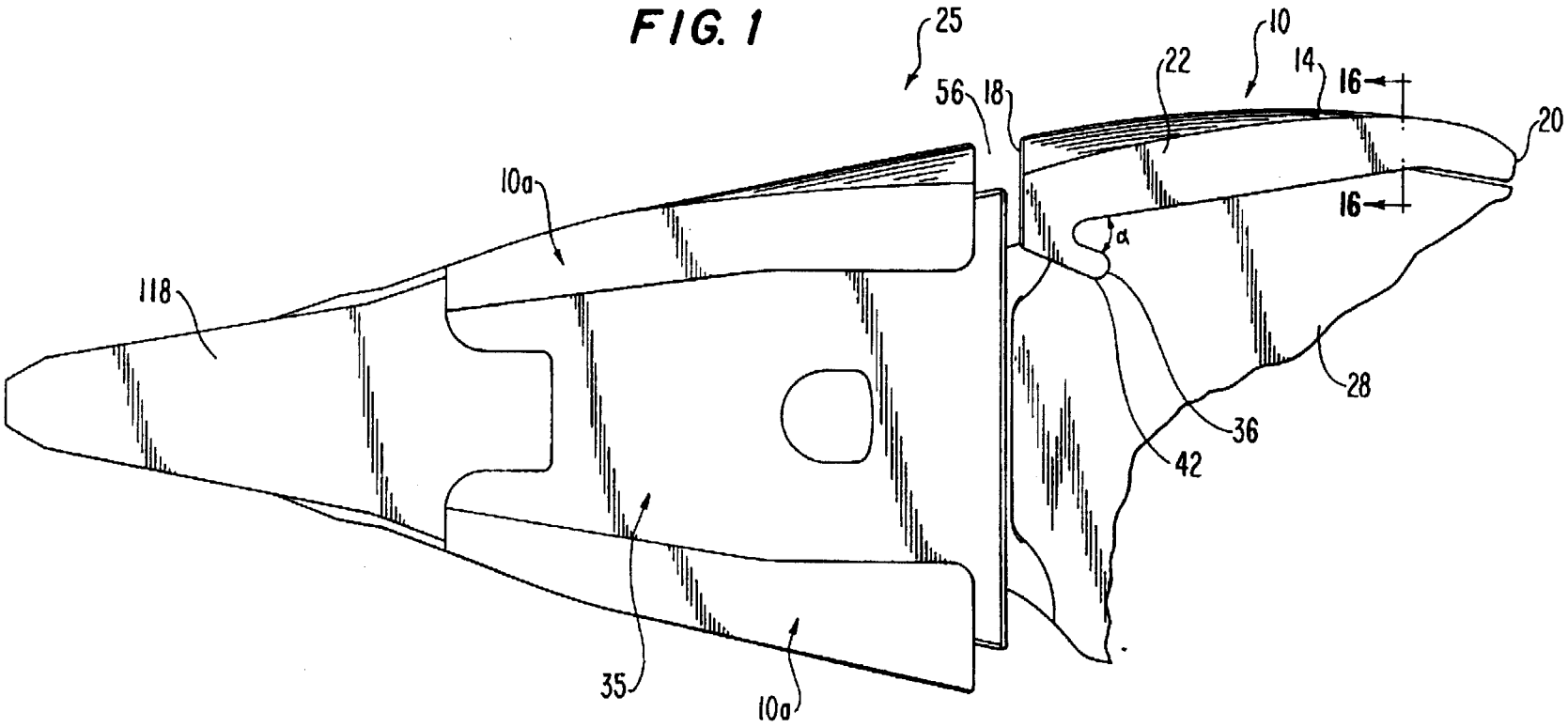
FIG 1 is a partial side view of a tooth having wear members in accordance with the present invention.

In accordance with the present invention, wear caps are used to protect surfaces which through use are subject to wearing. In this application, wear caps designed to protect wearable surfaces of an excavating tooth are described as an example of the present invention. Nonetheless, the invention is not so limited. Instead, the present wear caps can be used to protect a wide array of wearable surfaces on all kinds of excavating equipment and on other equipment (e.g., ore chutes) which are subject to wearing by the relative sliding movement of another material. As can be appreciated, the same concepts and structures described for the wear caps below would be applicable to the wear caps designed for attachment to other wearable surfaces.

In normal use, excavating teeth assume many different orientations. For purposes of explanation, the elements mentioned in this application are at times described in relative terms, such as up and down. These directions should be understood with respect to the orientation of the components as shown in FIG. 1, unless stated otherwise.

A wear cap 10 in accordance with the present invention includes an outer or wear surface 14, an inner or mounting surface 16, a front wall 18, a rear wall 20, and a pair of side walls 22, 24 (FIGS. 1–2 and 4–10). Although the wear cap preferably has a generally rectangular shape with four peripheral walls, other configurations could be used.

Figure 2:
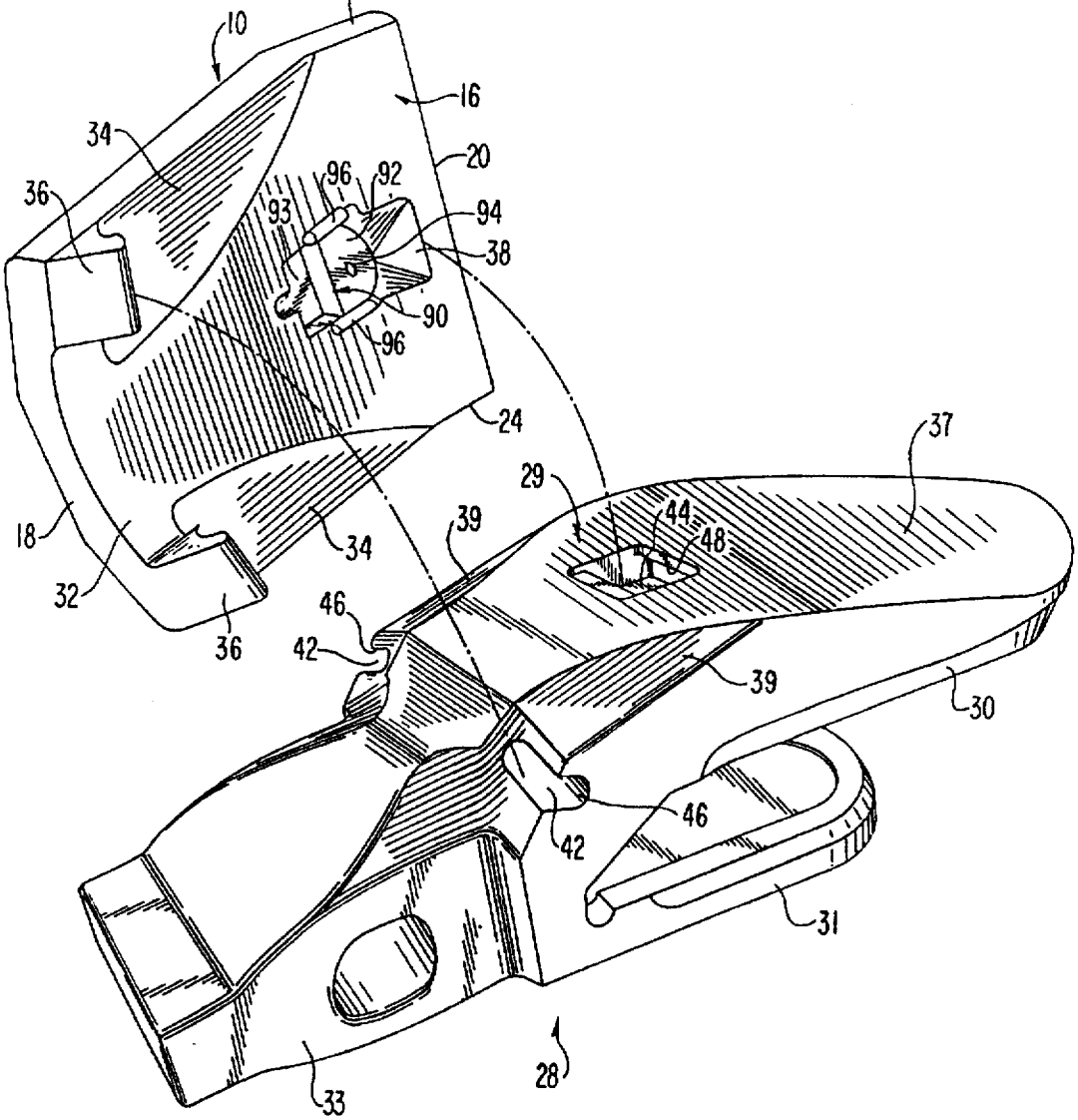
FIG. 2 is an exploded, partial perspective view of a wear cap and an adapter of the tooth.
Figure 3:
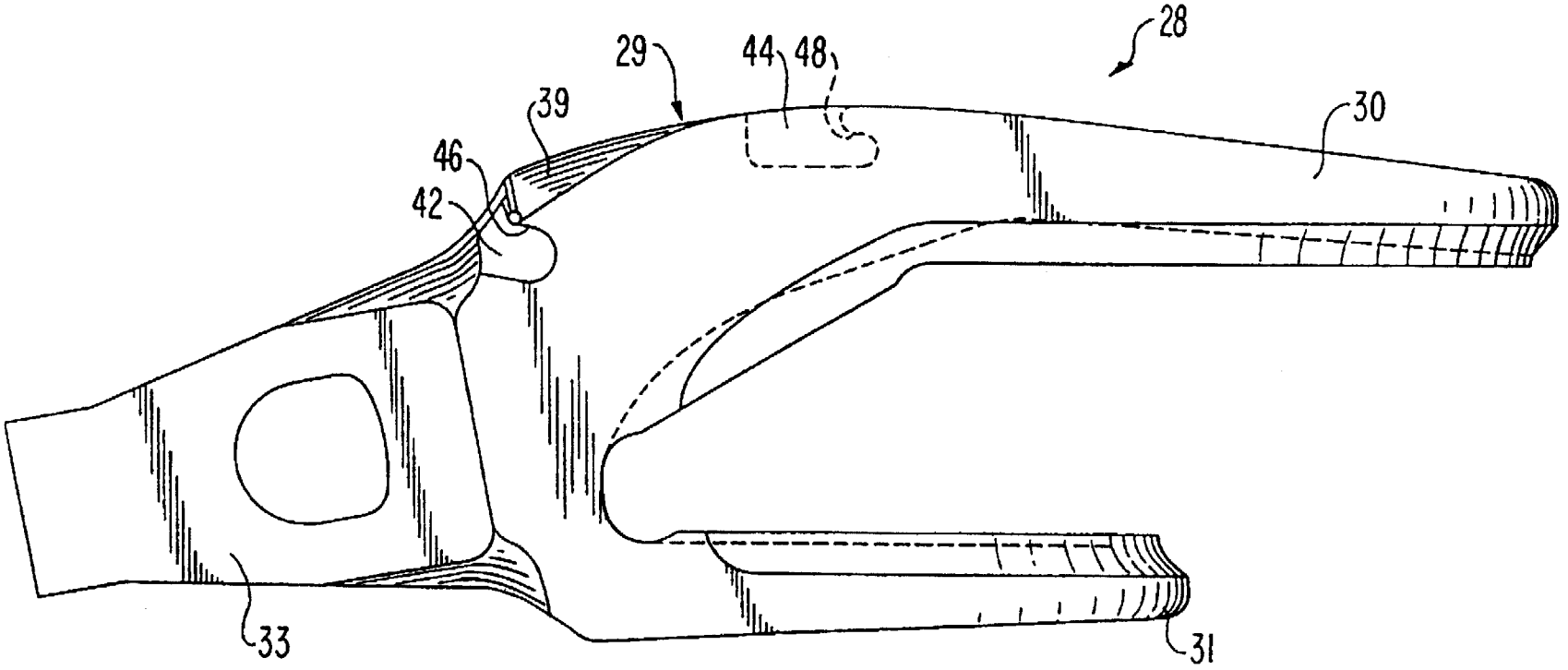
FIG. 3 is a side view of an adapter of the tooth.
Figure 3A:
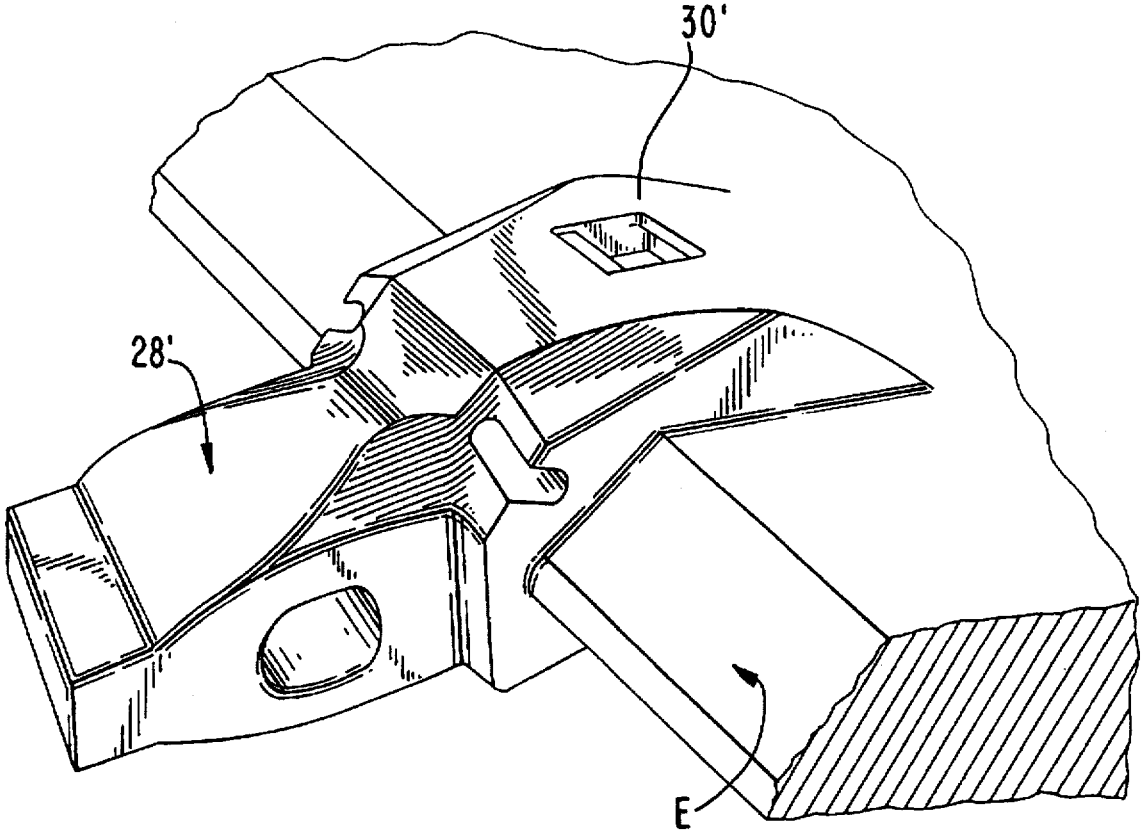
FIG. 3A is a perspective view of an alternative adapter construction.
Figure 4:
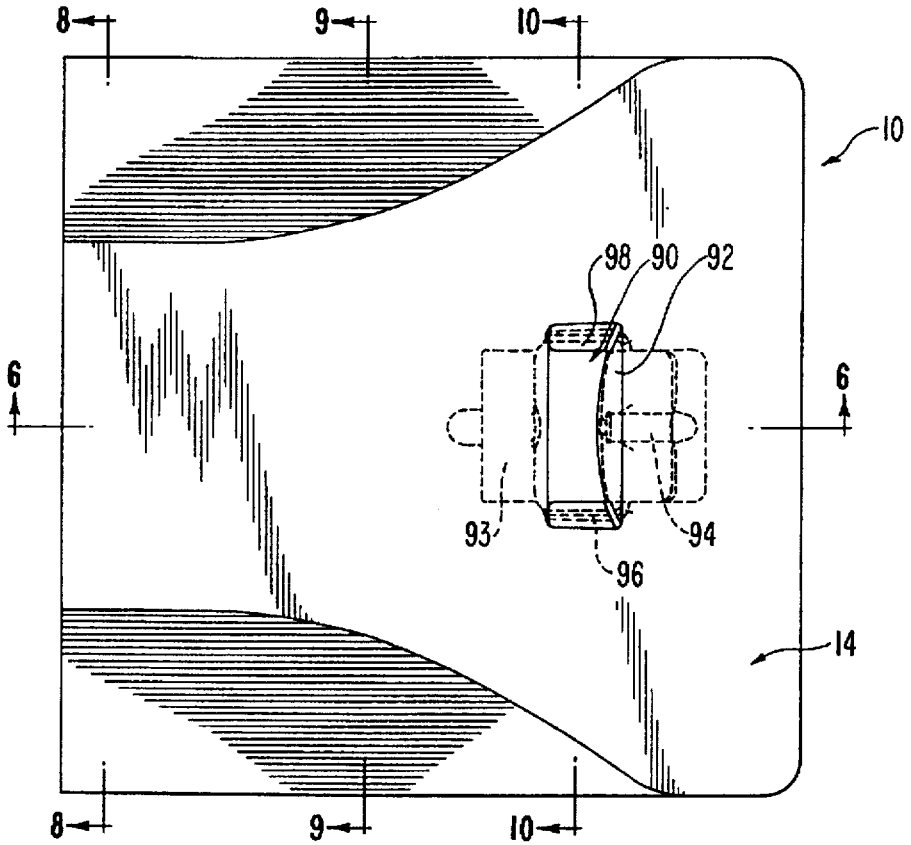
FIG. 4 is a top view of a wear cap for the tooth.
Figure 5:
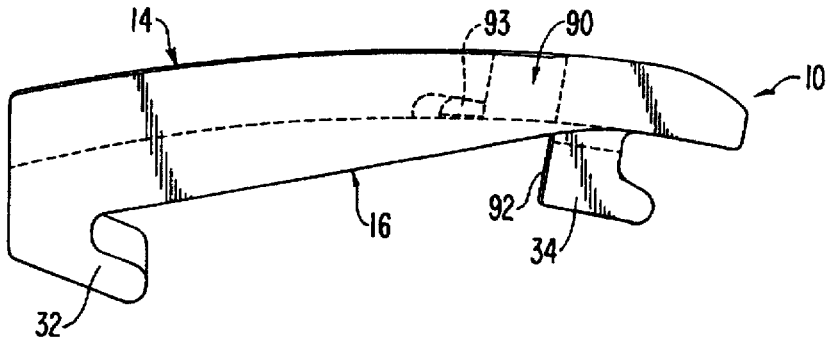
FIG. 5 is a side view of the wear cap.
Figure 6:
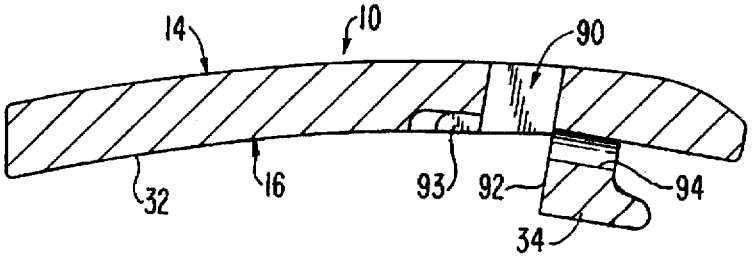
FIG. 6 is a cross sectional view taken along line 6—6 in FIG. 4.
Figure 7:
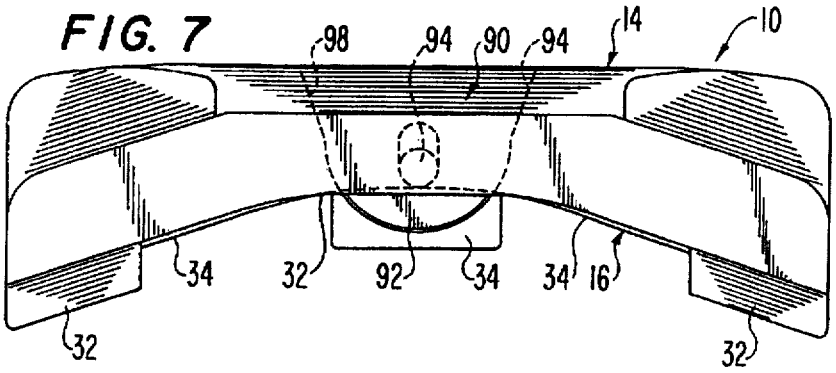
FIG. 7 is a front view of the wear cap.
Figure 8:
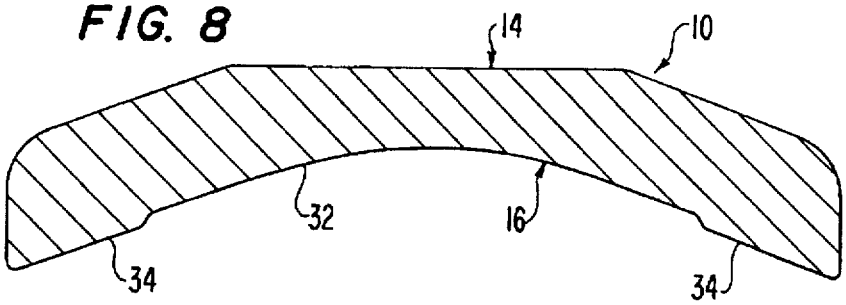
FIG. 8 is cross sectional view taken along line 8—8 in FIG. 4.
Figure 9:
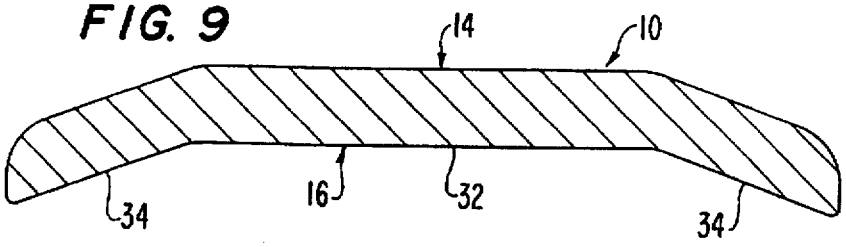
FIG. 9 is a cross sectional view taken along line 9—9 in FIG. 4.
Figure 10:
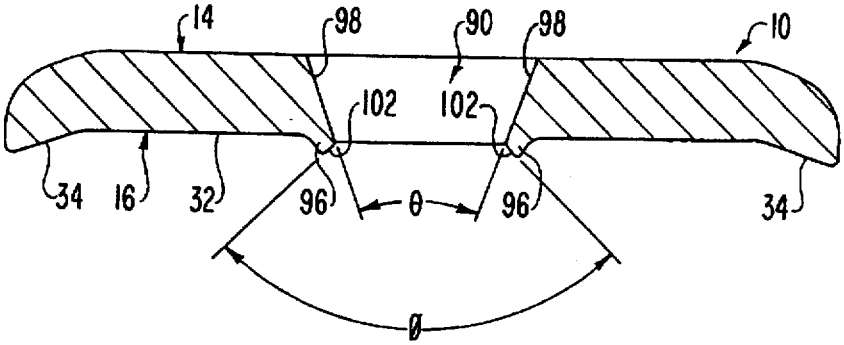
FIG. 10 is a cross sectional view taken along line 10—10 in FIG. 4.
Figure 11:
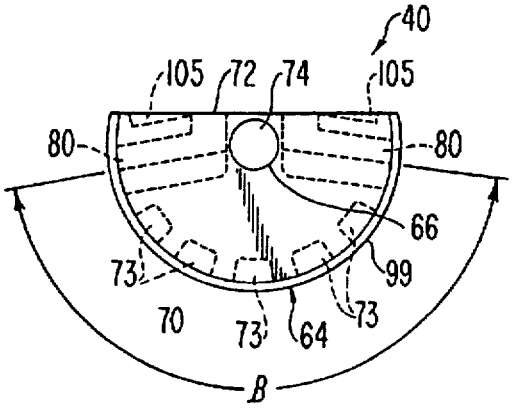
FIG. 11 is a front view of a lock in accordance with the present invention.
Figure 12:
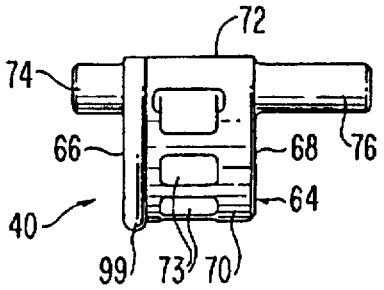
FIG. 12 is a side view of the lock.
Figure 13:
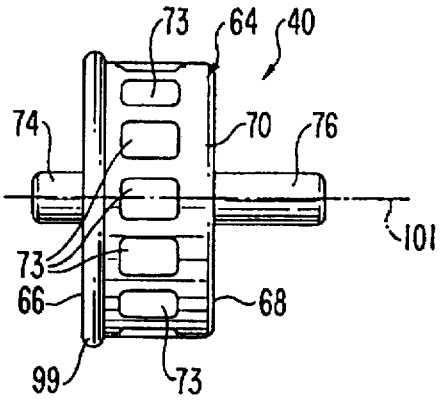
FIG. 13 is a side view of the lock rotated 90° with respect to FIG. 12.
Figure 14:
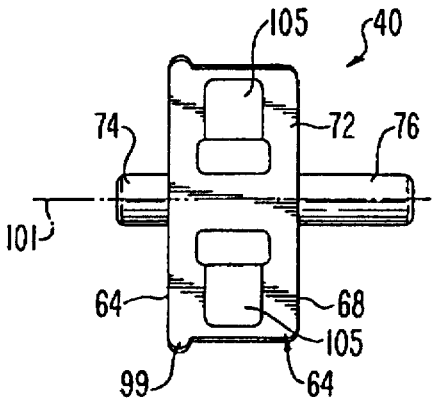
FIG. 14 is a side view of the lock rotated 180° with respect to FIG. 13.

In the present example, wear cap 10 is designed for attachment to an adapter 28 of an excavating tooth 25 (FIGS. 1–3). The adapter includes a pair of bifurcated legs 30, 31 which are secured to the lip of a bucket, and a nose 33 for mounting another wear member 35. Although legs 30, 31 are preferably welded to the lip, they may be attached by mechanical means as well. Alternatively, the mounting end 30' of the adapter 28' can be integrally cast with a digging edge E of an excavator (FIG. 3A). Wear cap 10 is attached to a wearable surface 29 of top leg 30 which is located directly rearward of nose 33. Wearable surface 29 includes a medial face 37 and a pair of inclined side faces 39. The medial face 37 is formed to have a generally convex configuration in the longitudinal direction. Side faces 39 are preferably planar but may have a slight convex or concave curvature. As a result of this construction, the wearable surface 29 is generally non-linear in both the lateral and longitudinal directions.

Wear cap 10 has a bowed configuration which is generally concave along its mounting surface 16 and generally convex along its wear surface 14 so that it generally conforms to the shape of wearable surface 29 (FIGS. 2 and 5–10). Mounting surface 16 is formed with a central portion 32 which is generally concave to overlie medial face 37 and a pair of generally planar flanking portions 34 (although the flanking portions could be slightly convex or concave) to overlie side faces 39. While flanking portions 34 engage side faces 39, central portion 32 is preferably spaced from medial face 37.

Wear cap 10 is secured to wearable surface 29 through the use of tabs 36, 38 and a lock 40 (FIGS. 2 and 5–7). Tabs 36, 38 each extend outward and rearward from mounting surface 16 to define a rearwardly opening fastener. In the preferred construction, three tabs are formed to provide a secure and balanced attachment to the wearable surface. Two front tabs 36 are positioned in lateral alignment on flanking portions 34 adjacent the front and side walls 18, 22, 24 of the wear cap. The rear tab 38 is centrally positioned rearward of front tabs 36 on central portion 32. Since rear tab 38 is alone and cooperates with lock 40, it is preferably wider and larger than each front tab 36. Alternatively, the tabs can be arranged in different locations or provided with different sizes. Additionally, the use of only two tabs or four or more tabs could be employed to secure a wear cap of the present invention.

To facilitate attachment of wear cap 10, wearable surface 29 includes three recesses 42, 44 for receiving tabs 36, 38 (FIGS. 2 and 3). Each recess 42, 44 is formed to define a retaining shoulder 46, 48. The recesses mirror the configuration of tabs 36, 38, so that two laterally aligned recesses 42 are formed near the front of side faces 39, and a central, rearward recess 44 is formed in medial face 37. While front recesses 42 are sized to generally conform to the size of front tabs 36, rear recess 44 is extended forwardly to also receive lock 40.

Tabs 36, 38 (FIGS. 2, 5 and 6) are each inclined in the same general direction to the surface 32, 34 from which they extend at an acute angle $\alpha$ of preferably about 30 degrees; although other inclinations could be used, the angle should generally be less than about 45°. Likewise, shoulders 46, 48 extend inward at essentially the same inclination as tabs 36, 38 (FIGS. 2 and 3). Tabs 36, 38 are received in recesses 42, 44 and engaged against shoulders 46, 48 to resist movement of wear cap 10 in rearward and outward directions relative to wearable surface 29. Removal of wear cap 10 is achieved by shifting the wear cap forwardly and upwardly as dictated by the engagement of tabs 32, 34 against shoulders 46, 48.

Due to the inclination and relatively short lengths of the tabs, wear cap 10 need only be shifted forwardly a distance equal to about ten percent of its entire length in order to effect removal. As a result, only a small gap 56 is needed between wear cap 10 and wear member 35 to remove the wear cap without removing the wear member 35 mounted on nose 33 (FIG. 1). While soil fines will typically compact in gap 56, the narrowness of the gap will effectively prevent the flow of material therethrough. As a result, the portion of the adapter exposed in gap 56 is shielded from excessive wearing by the compacted fines. In addition, despite the compaction of fines, wear cap 10 is relatively easy to remove because of the small amount of movement needed to release the wear cap.

A releasable lock 40 is provided to prevent removal of wear cap 10 from wearable surface 29 (FIGS. 11–20). Lock 40 includes a rigid hub 64, preferably formed as a unitary block, which has front and rear bearing faces 66, 68 and peripheral walls 70, 72. In the preferred construction, bearing faces 66, 68 are each formed to have a semi-circular configuration. Peripheral wall 70 forms an arcuate configuration conforming generally to the arc of a circle for about 180°–240°. Peripheral wall 72 is a substantially flat segment joining the two ends of wall 70. Front and rear shafts 74, 76 project orthogonally outward from bearing faces 66, 68 in lateral alignment with the center of peripheral wall 72. In the preferred construction, shafts 74, 76 are at the arcuate center of peripheral wall 70. As discussed below, this arrangement permits the lock to be rotated without requiring dislodgement of the intergranular bonding existing among soil fines compacted about the lock. Accordingly, Shafts 74, 76 are eccentrically positioned on bearing faces 66, 68, (i.e., off the geometric center of the bearing faces) adjacent peripheral wall 72, so that the hub 64 can be swung into its release and locked positions as the lock is rotated about the shafts. Shafts 74, 76 are preferably integrally cast with hub 64, but could also be attached by welding or other means.

A pair of resilient latches 78 project outward from sockets 80 defined in peripheral wall 70 (FIGS. 16–19). The latches are preferably spaced apart from each other at an angle β of about 160° (FIG. 11); although other spacings could be used. Each latch 78 comprises an elastomer 82, such as silicone rubber, fit into a socket 80 where it is protected by the hub, and an outwardly biased rigid metallic tip 84 (FIGS. 16–19). Tip 84 is bonded to elastomer 82. The distal end of tip 84 includes a pair of end walls 86 which taper to form a wedgeable end.

Figure 15:
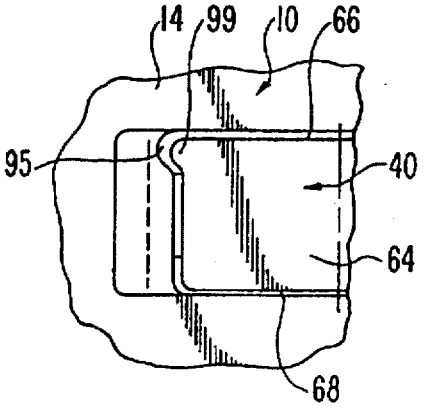
FIG. 15 is a partial top view of the lock received into an opening of the wear cap.

An opening 90 extending through wear cap 10 is provided to receive lock 40 (FIGS. 2, 4–7 and 16–20). In the preferred embodiment, opening 90 is formed immediately forward of rear tab 38, such that the front surface of tab 38 defines a bearing face 92. A longitudinal bore 94 extends through tab 38 for receiving rear shaft 76 (FIGS. 2 and 4–7). Front shaft 74 is received within a groove 93 to stabilize the lock. A pair of rails 96 lie along each side of opening 90 in the same general direction as bore 94. In the preferred construction, side walls 98 of opening 90 adjacent mounting surface 16 define a groove 95 for receiving a ridge 99 formed along the periphery of front bearing face 66 to ensure proper mounting of the longer rear shaft 76 in bore 94 (FIG. 15). Alteratively, the shafts could be made the same length to permit mounting in either orientation.

Figures 16, 17, 18, 19:
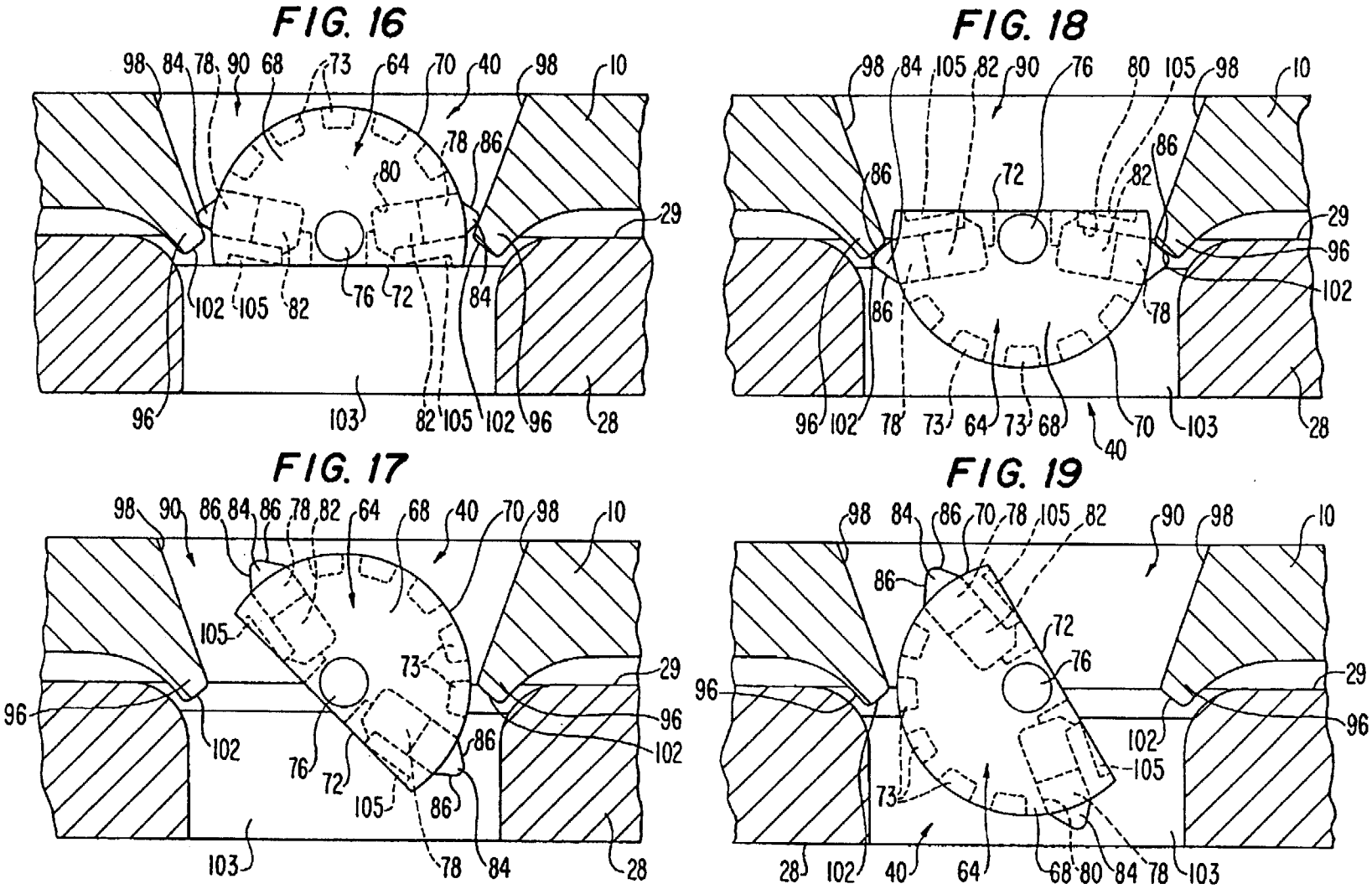
FIGS. 16–19 are partial cross sectional views taken along line 16—16 in FIG. 1, illustrating different orientations of the lock.

In use, rear shaft 76 is initially inserted into bore 94 with the linear peripheral wall 72 facing toward opening 90, as in its locked position (see FIG. 18). Lock 40 is rotated to place hub 64 in opening 90 before the wear cap is placed on wearable surface 29 (FIG. 16). At this point, lock 40 is in its release position wherein hub 64 is positioned in opening 90 with the flat peripheral wall 72 facing inward toward wearable surface 29. Hub 64 is positioned essentially above mounting surface 16 so as to permit insertion of tab 38 into recess 44. Tips 84 of latches 78 engage against the side walls 98 of opening 90 in the release position. As seen in FIGS. 16–19, side walls 98 are preferably inclined with respect to each other at an angle θ of about 40°, but may be varied within a range of about 0°–90°.

Figure 20:
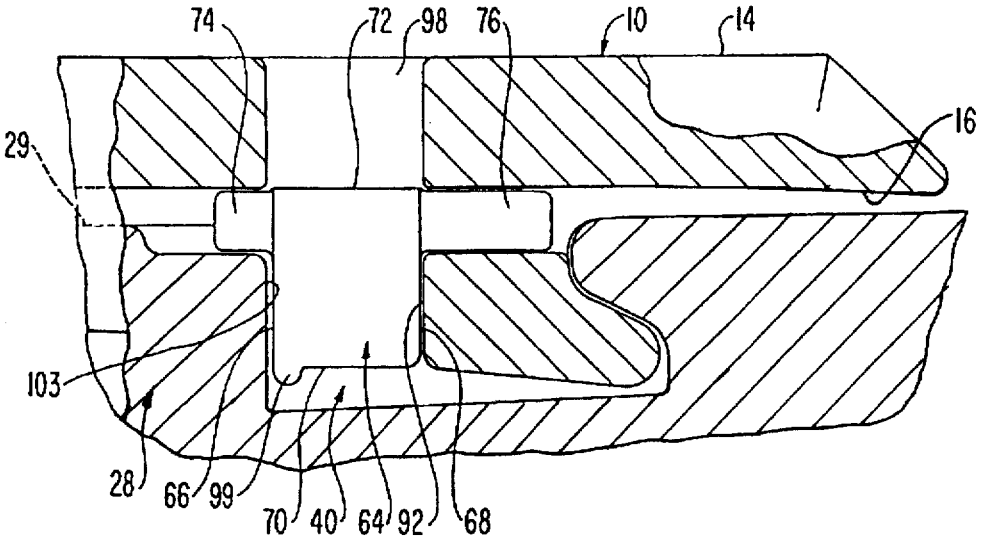
FIG. 20 is a partial side view of the wear cap and adapter in partial section, illustrating the lock in the locked position.
Figure 21:
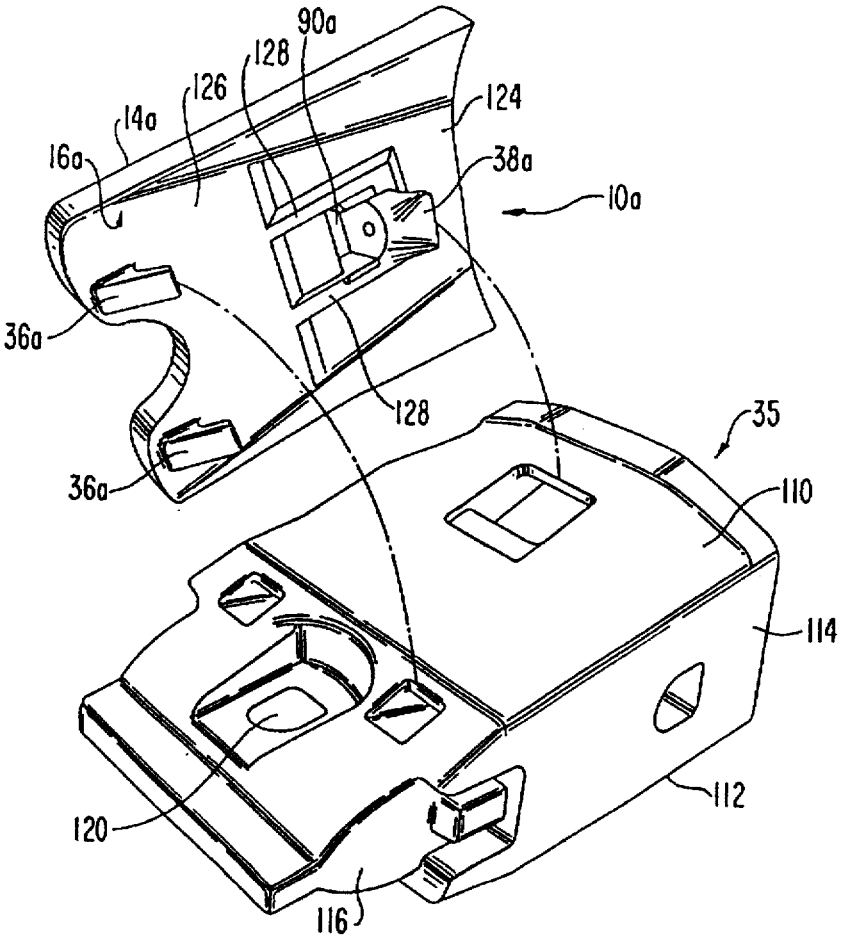
FIG. 21 is a exploded perspective view of another wear cap mounted to an adapter component (known by ESCO Corporation as a KWIK TIP® adapter) for the extricating tooth.

With wear cap 10 placed on wearable surface 29, opening 90 is substantially aligned with the extended front portion of recess 44. To secure wear cap 10 to wearable surface 29, lock 40 is turned (FIG. 17) to its locked position (FIGS. 18 and 20). An elongated tool (e.g., a screw driver or drift pin) is used to engage depressions 73 defined in arcuate peripheral wall 70 to rotate hub 64 about an axis 101 defined through shafts 74, 76. Latches 78 are successively compressed into sockets 80 as they clear the walls 98 of opening 90. In the locked position (FIG. 18), hub 64 is oriented such that the flat peripheral wall 72 faces outward away from wearable surface 29 and latches 80 abut rails 96. The bearing faces 102 of rails 96 are preferably inclined relative to each other at an angle ϕ of about 90° to matingly abut end walls 86 of tip 84. The angle ϕ of the bearing faces 102 could be varied within a range of 60°–180°. At angles of 120°–180°, contact with the latches 80 would be an edge contact with rails 96. In addition, the rails could be eliminated altogether such that latches 80 would abut against the mounting surface 16, but at the sacrifice of effective wear thickness of the wear cap. Alternatively, one or more latches may engage a keeper (not shown), such as a groove, to retain the lock in the locked position in lieu of the rails. One latch can be used so long as the keeper releasably prevents rotation of the lock in both directions.

In the locked position, rear bearing face 68 of lock 40 opposes bearing face 92 of wear cap 10, and front bearing face 66 opposes front bearing wall 103 at the front of recess 44 of adapter 28. With this construction, the rigid hub 64 of lock 40 prevents the wear cap from moving longitudinally along wearable surface 29. As a result, tabs 36, 38 cannot be released from recesses 42, 44, which in turn functions to independently secure wear cap 10 to wearable surface 29. The engagement of latches 80 against rails 96 functions to releasably retain hub 64 in its locked position. Since the axial loading is resisted by bearing faces 66, 68 of hub 64, latches 80 are not placed in a position to resist these loads.

The flat peripheral wall 72 preferably includes a pair of notches 105 near each end to facilitate turning of lock 40 to its release position. In particular, an elongate tool (e.g., a screw driver or a drift pin) is engaged in a notch 105 and pressed or impacted to rotate hub 64 about shafts 74, 76, against the bias of the latches 80 as they successively abut one of the rails 96. Rotation of hub 64 is achieved with relative ease even with the compaction of fines because the lock only needs to overcome whatever bonding forces exist between the lock and the fines, and does not need to overcome the intergranular bonding strength of the fines themselves. Rotation of the hub is continued until it reaches the release position. At this point, wear cap 10 can be removed from wearable surface 29 by a forward and upward movement.

Figure 22:
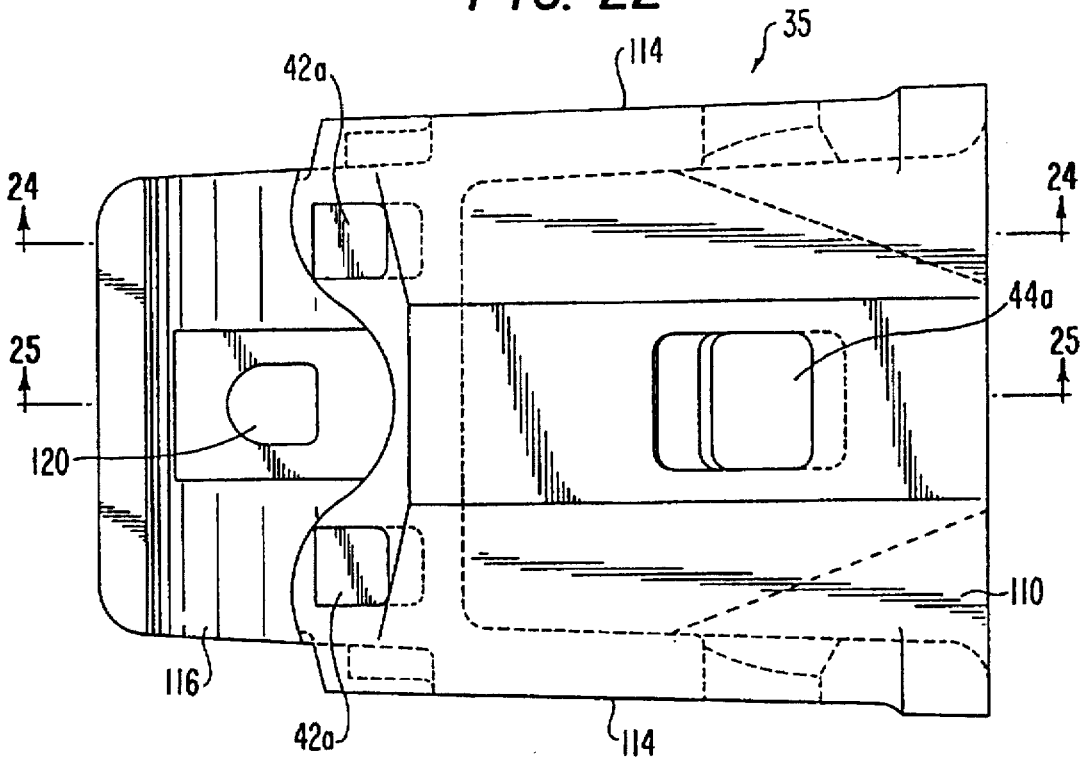
FIG. 22 is a top view of the other adapter component.
Figure 23:
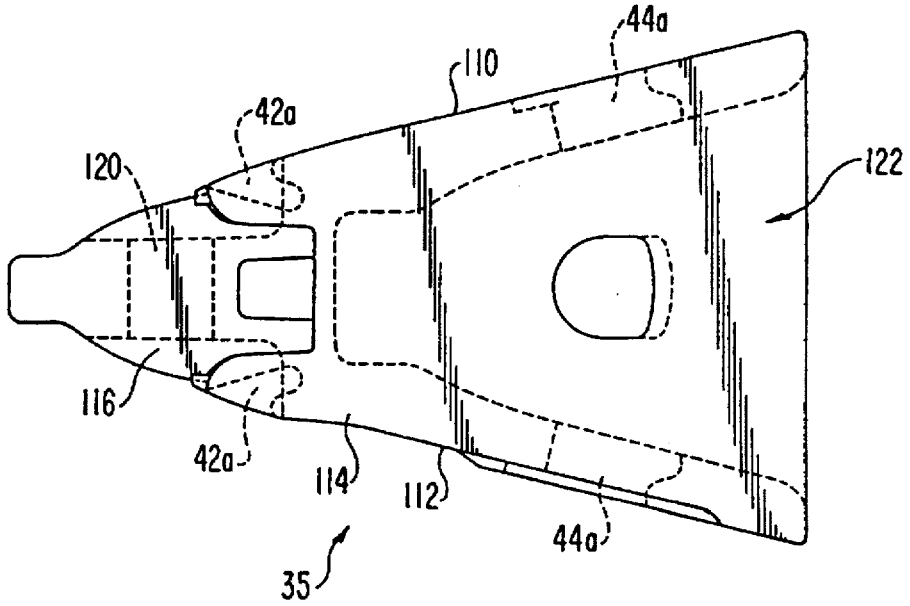
FIG. 23 is a side view of the other adapter component.
Figure 24:
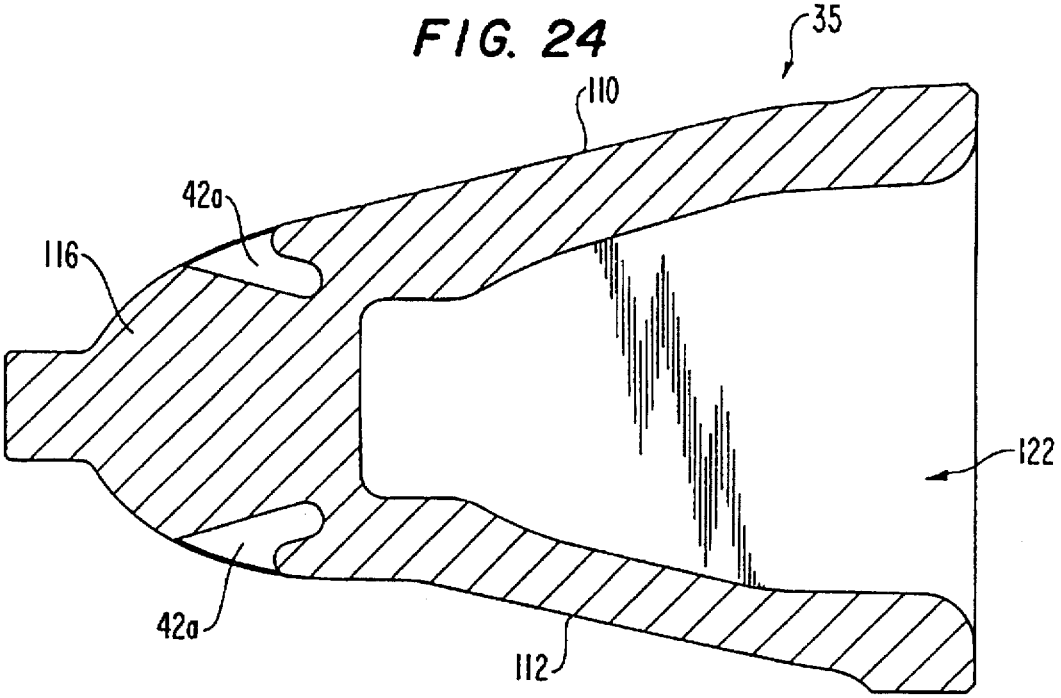
FIG. 24 is a cross sectional view taken along line 24—24 in FIG. 22.
Figure 25:
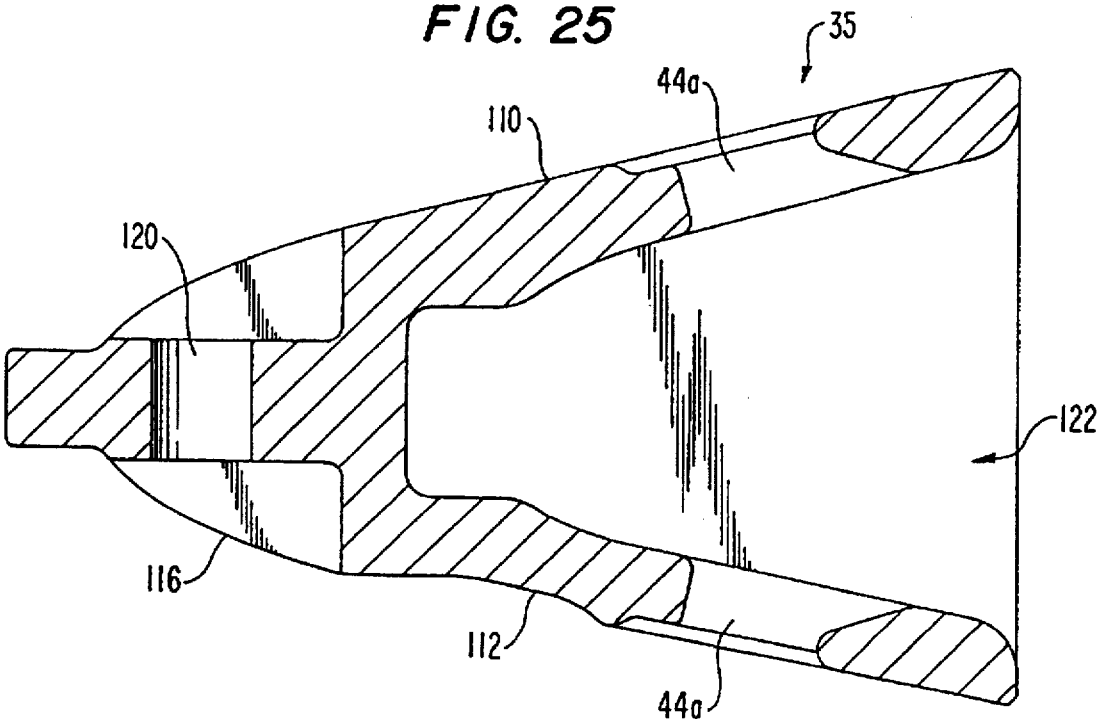
FIG. 25 is a cross sectional view taken along line 25—25 in FIG. 22.
Figure 26:
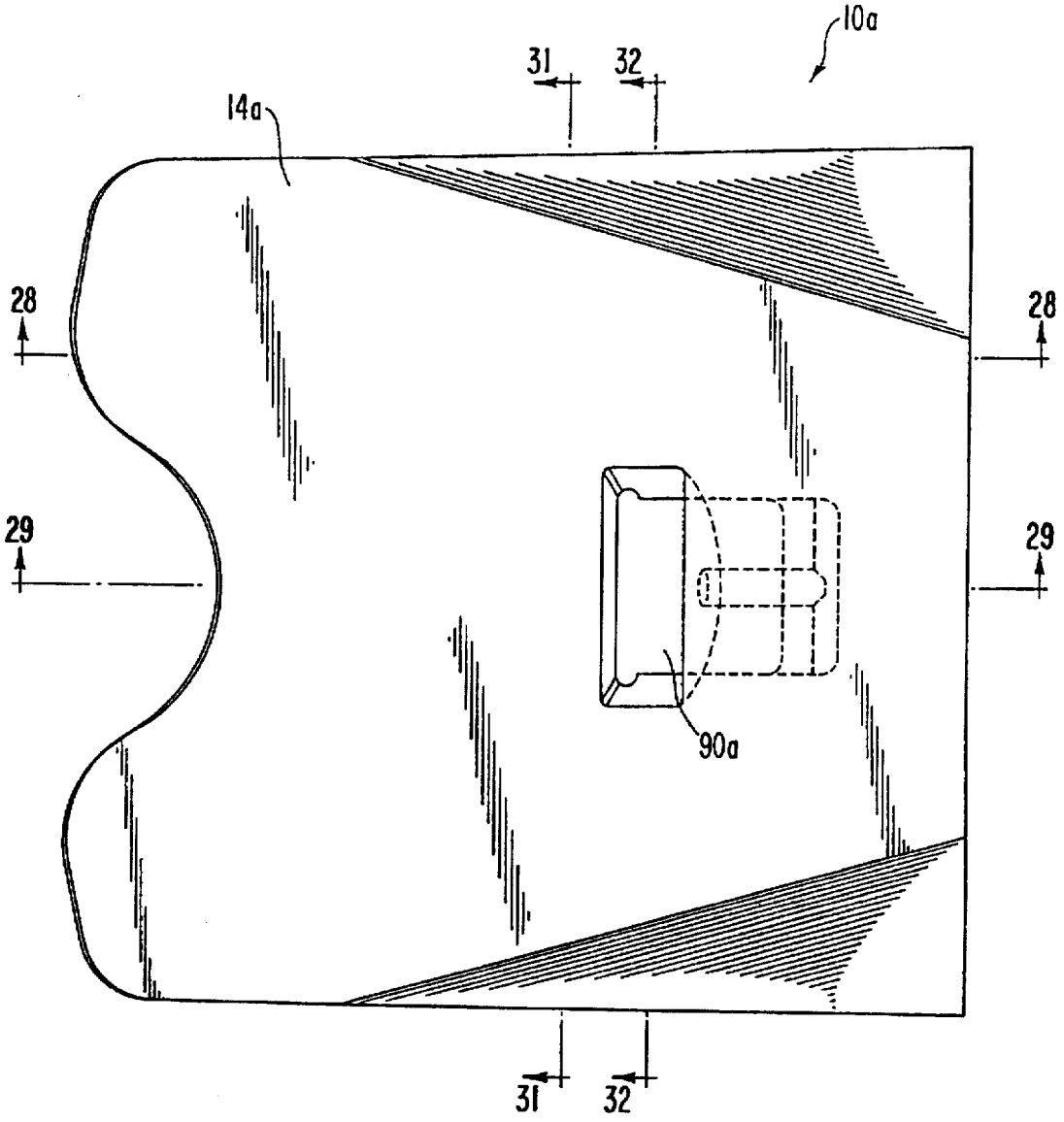
FIG. 26 is a top view of the other wear cap.
Figure 27:
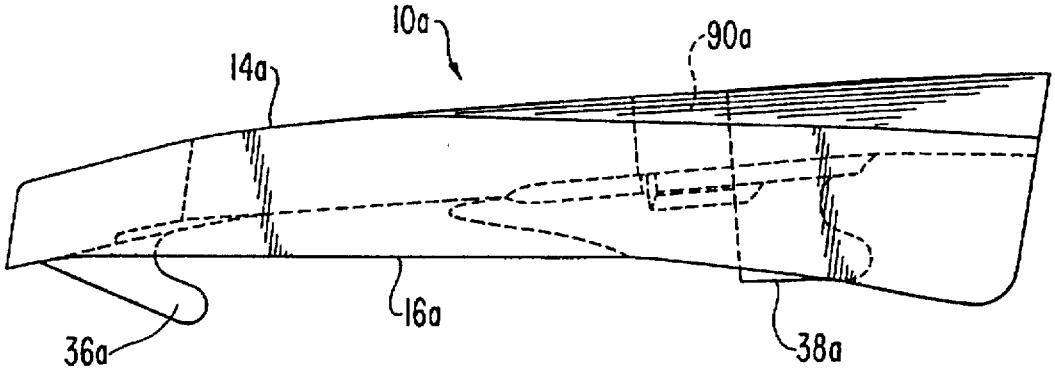
FIG. 27 is a side elevational view of the other wear cap.
Figure 28:
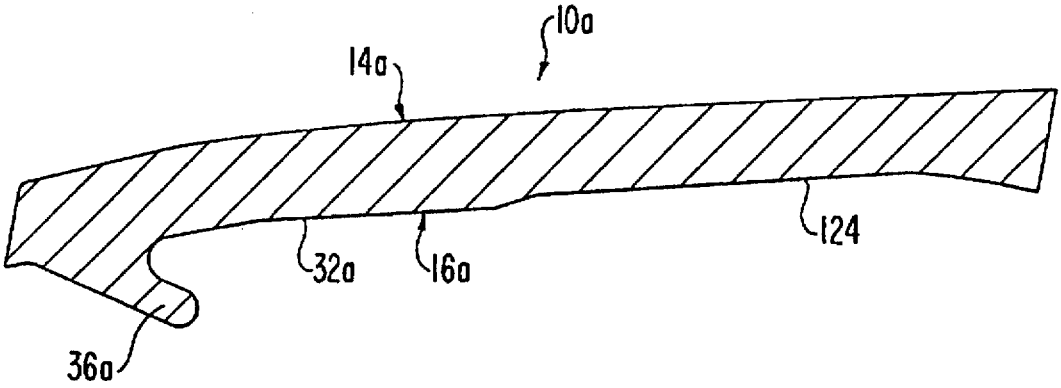
FIG. 28 is a cross sectional view taken along line 28—28 in FIG. 26.
Figure 29:
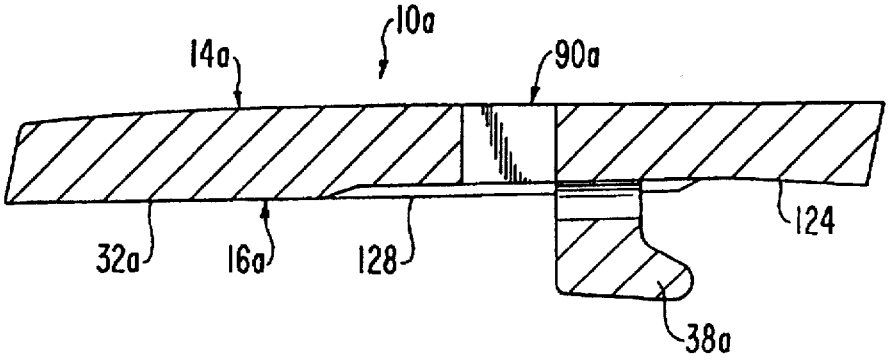
FIG. 29 is a cross sectional view taken along line 29—29 in FIG. 26.
Figure 30:
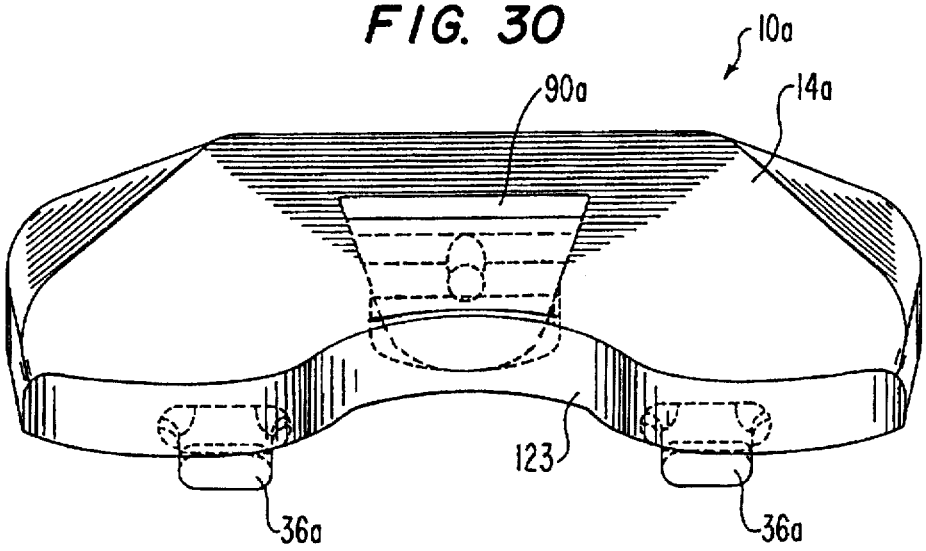
FIG. 30 is a front view of the other wear cap.
Figure 31:
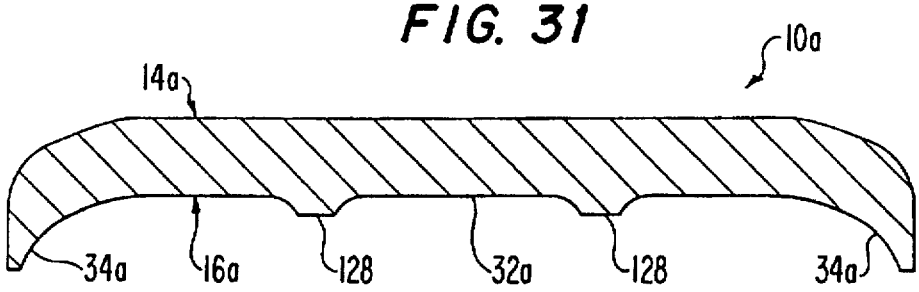
FIG. 31 is a cross sectional view taken along line 31—31 in FIG. 26.
Figure 32:
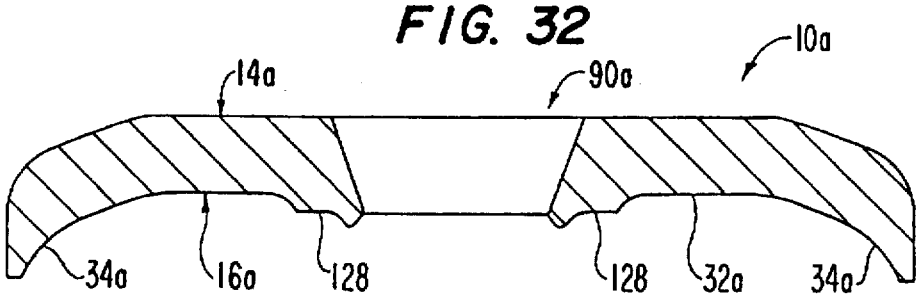
FIG. 32 is a cross sectional view taken along line 32—32 in FIG. 26.

In the illustrated example, wear member 35 is an adapter component (known by ESCO Corporation as a KWIK TIP® adapter) of a multi-part tooth. Nonetheless, the attachment of wear cap 10 would be the same even if the wear member attached to nose 33 was a point or other member. Wear member 35 comprises a top wall 110, a bottom wall 112, and a pair of sidewalls 114. The top and bottom walls 110, 112 are tapered toward the front end which is formed to define a nose 116. The nose is adapted to mount a point 118 (FIG. 1), which is secured to the nose by a conventional lock arrangement (not shown) received into hole 120 (FIGS. 22, 23, and 25). Wear member 35 further includes a rearwardly opening socket 122 into which nose 33 of adapter 28 is received (FIGS. 22–25). Wear member 35 is preferably secured to adapter 28 by an extensible lock disclosed in the co-pending U.S. patent application Ser. No. 08/570,438, entitled "Excavating Tooth" and filed on the same day herewith by inventors Larren F. Jones and Robert K. Emrich (attorney docket no. 51291.52544), which is hereby incorporated by reference. Nevertheless, other locking arrangements could also be used.

Top and bottom walls 110, 112 are wearable surfaces which are protected by wear caps **10*a*. Each wear cap 10*a* has essentially the same construction as wear cap 10, except that it is shaped to generally conform to the shape of walls 110, 112. In particular, wear cap 10*a*** includes a wear surface 14a, a mounting surface 16a, a plurality of tabs 36a, 38a projecting from mounting surface 16a, and an opening 90a for receiving a lock 40. Unlike wear cap 10, all of the tabs 36a, 38a of wear cap 10a extend from a generally planar central portion 32a. Further, flanking portions 34a extend along the rear portion of wear cap 10a. The extent of the flanking portions is variable. For instance, if desired, the flanking portion could include wings (not shown) which extend along the sides of wear member 35. Front wall 18a is formed with a central relief 123 to provide clearance for receipt of the lock into hole 120.

Further, in the preferred embodiment, the rearward end 124 of central portion 32a has a thinner construction than the front end 126 for material savings. Longitudinal ribs 128 are formed to provide added strength and rigidity to the wear cap, and to provide contact surfaces with wear member 35. Of course, other arrangements could be used to enhance the member's strength. The thinner construction of rearward end 124 provides sufficient clearance for shaft 74 to lie between wear cap 10 and wearable surface 29 to thereby stabilize the lock.

Tabs 36a, 38a of wear cap 10a are received in recesses 42a, 44a in the same way as discussed for wear caps 10. Additionally, lock 40 is usable with wear cap 10a and wearable surface 29 in the same way as discussed above for wear cap 10 and wearable surface 29. Nevertheless, locks which are varied in shape and size may be used as desired. For instance, a lock in accordance with the teachings of U.S. Pat. Nos. 5,088,214 and 5,241,765 could be used.

The above discussion concerns the preferred embodiments of the present invention. Various other embodiments as well as many changes and alterations may be made without departing from the spirit and broader aspects of the invention as claimed.

We claim:

1. A wear assembly comprising:

a structural member having a wearable surface, said wearable surface including a plurality of recesses;

a wear cap to protect said wearable surface, said wear cap including a pair of opposite ends, a wear surface remote from the wearable surface, a mounting surface facing the wearable surface, a plurality of tabs projecting outward from said mounting surface and in the general direction of one of said ends to be received in said recesses defined in the wearable surface, at least one tab being spaced closer to one said end than at least one other said tab, an opening extending through said wear cap, and a bearing surface defined in said opening; and a lock received in said opening and in abutment with said structural member and said bearing surface for securing said wear cap to said structural member.

2. A wear assembly in accordance with claim 1, in which said tabs extend from said mounting surface in generally the same direction.

3. A wear assembly in accordance with claim 2, in which said tabs are inclined at an acute angle to said mounting surface.

4. A wear assembly in accordance with claim 1, in which said plurality of tabs includes at least one front tab and at least one rear tab.

5. A wear assembly in accordance with claim 4, in which said opening is positioned adjacent said rear tab.

6. A wear assembly in accordance with claim 1, further including a plurality of rails adjacent said opening to interact with said lock.

7. A wear assembly in accordance with claim 1, in which said opening is positioned adjacent one of said tabs such that said one tab includes a bearing face along one side of said opening.

8. A wear assembly in accordance with claim 1, in which said lock includes a rigid hub provided with a front bearing surface, a rear bearing surface, and at least one shaft projecting from one of said bearing surfaces, wherein said hub is rotatable about said shaft between a release position and a locked position.

9. A wear assembly in accordance with claim 8, which further includes at least one resilient latch which extends outward to releasably retain said hub in said locked position.

10. A wear assembly in accordance with claim 1, in which said structural member is an adapter which includes a rear mounting end and a forwardly projecting nose for mounting a wear member.

11. A wear assembly in accordance with claim 1, in which said wearable surface is provided with at least one front recess and at least one rear recess, wherein each said recess has a shoulder adapted to engage one of said tabs, and all of said shoulders are inclined in the same general direction.

12. A wear cap to protect a wearable surface, said wear cap including a pair of opposite ends, a wear surface adapted to be remote from the wearable surface, a mounting surface adapted to face the wearable surface, a plurality of tabs projecting outward from said mounting surface and in the general direction of one of said ends to be received in recesses defined in the wearable surface, at least one tab being spaced closer to one said end than at least one other said tab, and an aperture opening in said mounting surface extending through said wear cap for receiving a lock to secure the wear cap to the wearable surface, said opening having a bearing surface for abutting the lock.

13. A wear cap in accordance with claim 12, in which said tabs extend from said mounting surface in generally the same direction.

14. A wear cap in accordance with claim 13, in which said tabs are inclined at an acute angle to said mounting surface.

15. A wear cap in accordance with claim 12, in which said plurality of tabs includes at least one front tab and at least one rear tab.

16. A wear cap in accordance with claim 15, in which said plurality of tabs includes a pair of spaced apart front tabs and a central rear tab.

17. A wear cap in accordance with claim 16, in which said opening is positioned adjacent said rear tab.

18. A wear cap in accordance with claim 17, in which said rear tab includes a longitudinal bore for receiving a shaft of the lock.

19. A wear cap in accordance with claim 12, further including a plurality of rails adjacent said opening to interact with the lock.

20. A wear cap in accordance with claim 12, in which said opening is positioned adjacent one of said tabs such that said one tab includes a bearing face along one side of said opening.

21. A wear cap in accordance with claim 20, in which a bore is formed in said bearing face to receive a shaft of the lock.

22. A wear cap in accordance with claim 12, in which said wear cap has a generally bowed configuration.

23. A wear cap in accordance with claim 12, in which said wear cap has a generally straight configuration.

24. A wear cap in accordance with claim 12, in which said tabs are inclined at an acute angle to said mounting surface.

25. A wear cap to protect a wearable surface, said wear cap having a wear surface adapted to be remote from the wearable surface, a mounting surface adapted to face the wearable surface, a pair of opposite ends, a plurality of tabs projecting outward from said mounting surface at acute angles and in generally the same direction toward one of said ends to be received in recesses defined in the wearable surface, at least one of said tabs being spaced closer to one end than another of said tabs.

26. A wear cap in accordance with claim 25, in which said plurality of tabs includes at least one front tab and at least one rear tab.

27. A wear cap in accordance with claim 26, in which said plurality of tabs includes a pair of spaced apart front tabs and a central rear tab.

28. A wear cap in accordance with claim 25, which further includes an opening extending through said wear cap to receive a lock.

29. A wear cap in accordance with claim 28, in which said opening is positioned adjacent one of said tabs along a side opposite said inclination of said tabs.

30. A wear cap in accordance with claim 29, in which said one tab includes a bearing face along one side of said opening.

31. A wear cap in accordance with claim 30, in which a bore is formed in said bearing face to receive a shaft of the lock.

32. A lock for securing a wear cap to a wearable surface, said lock comprising a rigid hub having a front bearing surface and a rear bearing surface each having a peripheral edge, at least one shaft projecting from one of said bearing surfaces near said peripheral edge, said hub being rotatable about said shaft between a release position and a locked position, and at least one resilient latch extending outward to releasably retain said hub in said locked position.

33. A lock in accordance with claim 32, in which said bearing surfaces each have a generally semi-circular configuration.

34. A lock in accordance with claim 32, further including a peripheral wall interconnecting said bearing surface, said peripheral wall having a plurality of depressions to effect rotation of said lock between said release and locked positions.

35. A lock in accordance with claim 34, in which said resilient latch projects from said peripheral wall.

36. A lock in accordance with claim 34, in which a pair of spaced apart latches project from said peripheral wall.

37. A lock in accordance with claim 32, which further includes a pair of aligned shafts, wherein one shaft extends orthogonally from each of said bearing faces.

38. An adapter for an excavating tooth comprising a rear mounting end and a forwardly projecting nose for mounting a wear member, said mounting end having a wearable surface provided with at least one front recess and at least one rear recess, each said recess having a shoulder adapted to engage a tab for securing a wear cap, all of said shoulders being inclined at acute angles relative to said wearable surface in the same general direction.

39. An adapter in accordance with claim 38, in which said plurality of recesses includes a pair of spaced apart front recesses and a central rear recess.

40. An adapter in accordance with claim 38, in which said mounting end includes at least one leg adapted to be attached to a digging edge of an excavator.

41. An adapter in accordance with claim 38, in which said mounting end includes a rearwardly opening socket for receiving a nose of another adapter.

42. An adapter in accordance with claim 38, in which said mounting end is integrally cast with a digging edge of an excavator.

43. An adapter for an excavating tooth comprising a rear mounting end and a forwardly projecting nose for mounting a wear member, said mounting end having a wearable surface provided with a plurality of recesses each having a shoulder adapted to engage a tab for securing a wear cap, at least one of said recesses being spaced farther from said nose than at least one other of said recesses, and at least one of said recesses having a larger opening in said wearable surface than at least one other of said recesses to receive a lock therein for securing the wear cap to the adapter.

44. An adapter in accordance with claim 43, in which said shoulders are all inclined in the same general direction.

45. An adapter in accordance with claim 43, in which said plurality of recesses includes at least one front recess and at least one rear recess.

46. An adapter in accordance with claim 45, in which said plurality of recesses includes a pair of spaced apart front recesses and a central rear recess.

47. An adapter in accordance with claim 43, in which said recess which is extended forwardly is partially defined by a front bearing wall for abutting a lock.

* * * * *